US006094863A

United States Patent [19]

LaCook, Jr.

[11] Patent Number: 6,094,863

[45] Date of Patent: Aug. 1, 2000

[54] ATTACHMENT TO RETROFIT EXISTING SAFETY GATES TO IMROVE THE SAFETY AFFORDED BY THE GATES

[76] Inventor: Hardy L. LaCook, Jr., 2012 Karbach, Houston, Tex. 77092

[21] Appl. No.: 09/253,233

[22] Filed: Feb. 19, 1999

[51] Int. Cl.[7] ..... E01F 13/00

[52] U.S. Cl. ..... 49/49

[58] Field of Search ..... 49/49, 501, 42, 49/44, 46, 50, 54

[56] References Cited

U.S. PATENT DOCUMENTS

D. 188,190 6/1960 Stevens ..... 49/49

3,866,356 2/1975 Lacook et al. .

4,290,230 9/1981 t'Kint de Roodenbeke ..... 49/49

FOREIGN PATENT DOCUMENTS 290699 6/1991 Germany ..... 49/49

*Primary Examiner*—Jerry Redman

[57] ABSTRACT

An attachment is provided for a safety gate that is positioned to close the opening in a catwalk to allow access to and from a ladder or stairs. The gate is urged to the closed position by springs. The improvement is an attachment for connecting to the lower side of existing gates to prevent workmen using the catwalk from slipping under the gate and falling into the opening for stairs or a ladder.

5 Claims, 2 Drawing Sheets

FIG. 1
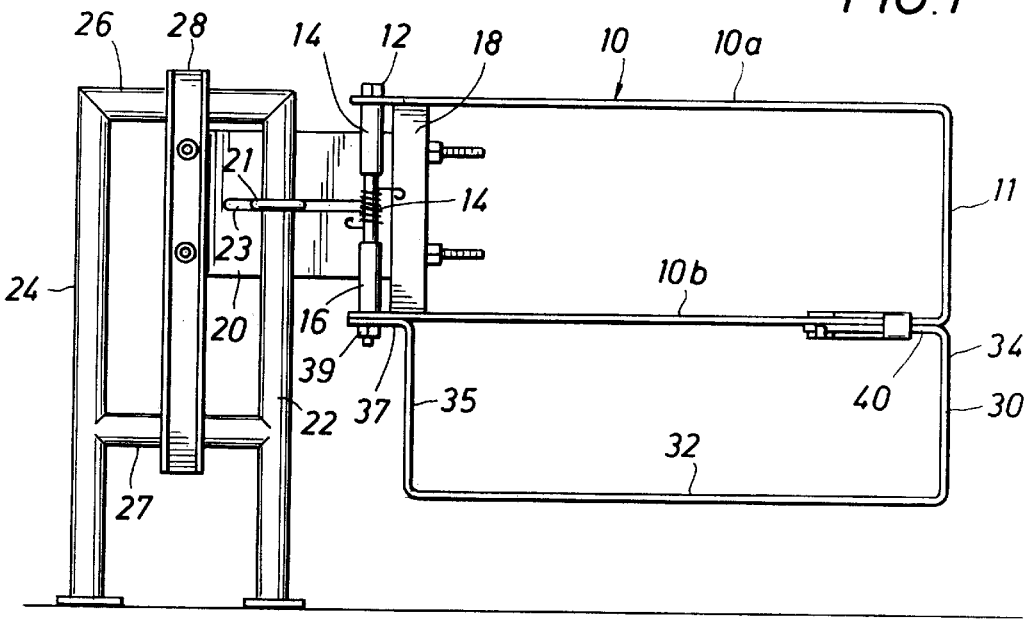
FIG. 3
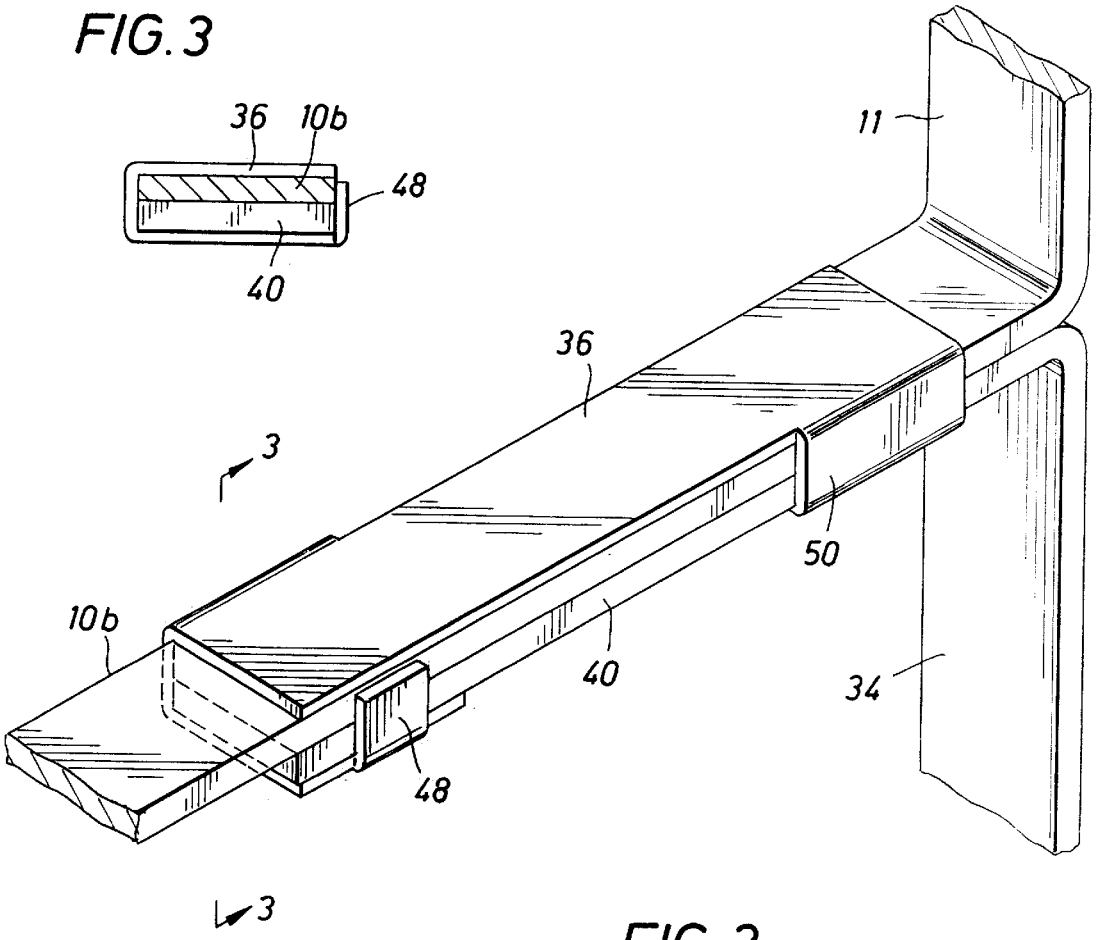
FIG. 2

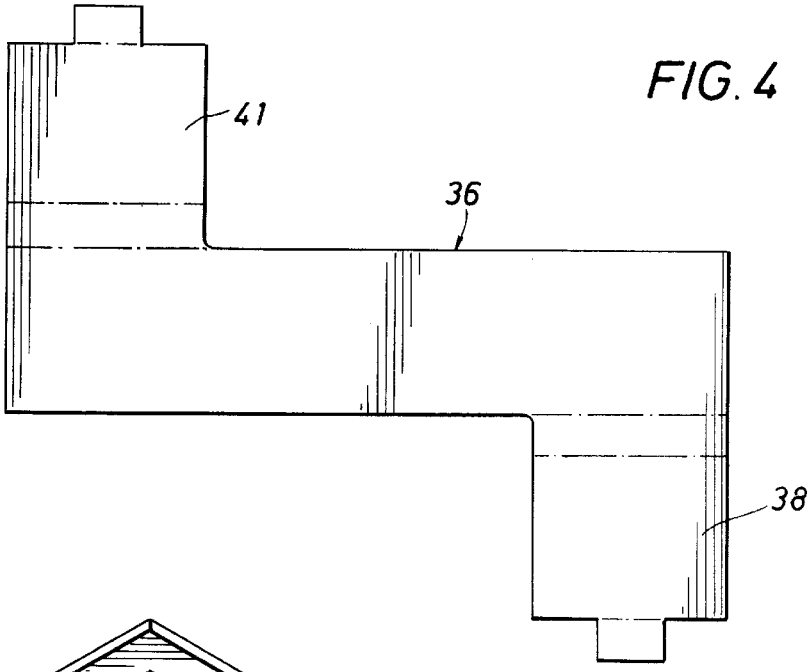
FIG. 4
FIG. 5
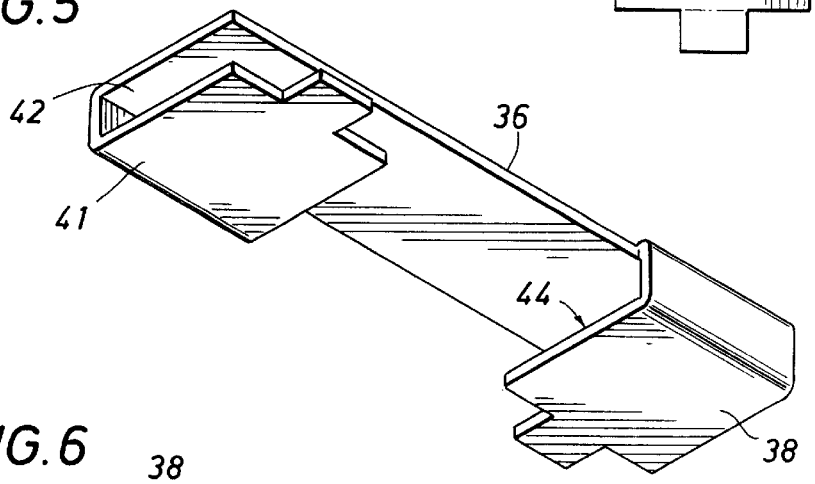
FIG. 6
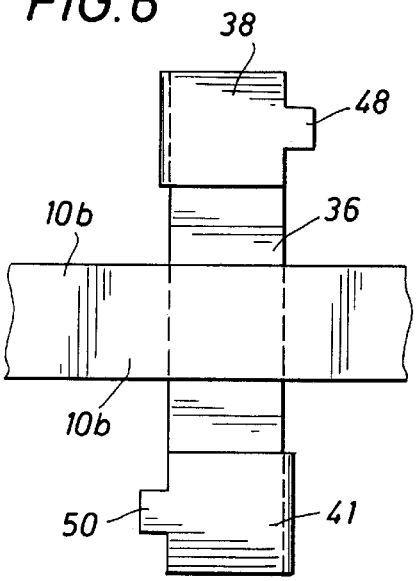
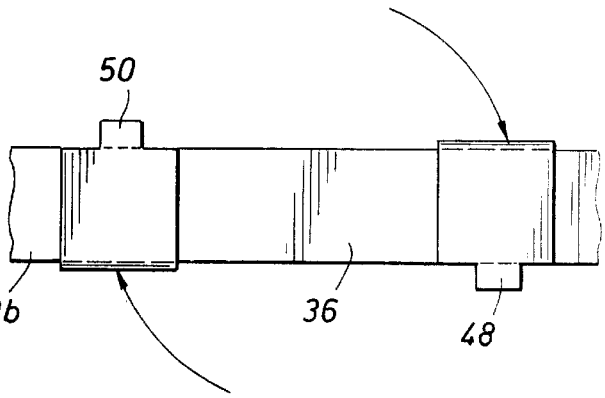
FIG. 7

ATTACHMENT TO RETROFIT EXISTING SAFETY GATES TO IMROVE THE SAFETY AFFORDED BY THE GATES

BACKGROUND OF THE INVENTION

This invention relates to an attachment for improving the safety of the gates that are used to close the openings in the guard rails of walkways for ladders and stairs leading to and from a walkway.

In nearly all industrial plants, there are walkways from which a worker could fall to a lower level. For safety's sake, these walkways are usually provided with guard rails to help prevent a worker from accidentally stepping off the side of the walkway and falling. For various reasons, however, it is necessary to provide openings in the guard rails. Usually, for example, one or more ladders or stairs lead from the walkway to a lower level. Openings are provided in the guard rails so that a person can move from the ladders or stairs onto the walkway and vice versa. Such openings in the guard rails are a danger to personnel using the walkway.

U.S. Pat. No. 3,866,356 that issued Feb. 18, 1975 described a safety gate specifically designed to keep personnel from inadvertently falling from the walkway into the openings for the stairs or ladders, hereinafter "stairwells". The safety gate of the '356 patent has enjoyed tremendous commercial success and can be found throughout the industrial world protecting workers from inadvertently falling through the stairwells in catwalks.

The gate of the '356 patent is positioned about waist high to a worker standing on the catwalk. As a result, there exists an opening between the gate and the catwalk through which it is possible for a worker to slide feet first under the gate into the stairwell. No such accident has been reported to date although these gates have been in use throughout the world for many years.

Nevertheless, there is a need to provide an attachment for these gates that will extend the gate downwardly to a position closer to the catwalks to reduce the chances of a worker slipping under the gate into a stairwell and it is an object of this invention to provide such an attachment and apparatus for connecting the attachment to existing gates quickly and easily without making any changes in the existing gate.

These and other objects, advantages, and features of this invention will be apparent to those skilled in the art from a consideration of this specification, including the attached drawings and appended claims.

IN THE DRAWINGS

FIG. 1 is a side view of the gate of the '356 patent with the attachment of this invention attached to the lower side of the gate.

FIG. 2 is an isometric view of the portion of the gate of FIG. 1 showing the unique connector designed to allow the attachment to be connected to existing gates quickly and easily and without use of bolts or welds or the like to connect the attachment to the existing gate.

FIG. 3 is a sectional view taken along line 3—3 of FIG. 2.

FIG. 4 is a plan view of the connector shown in FIG. 2 showing the shape of the connector before it is bent into the shape for connecting the attachment to the gate.

FIG. 5 is an isometric view of the connector after it has been formed into the shape for connecting the attachment as shown in FIG. 2.

FIGS. 6 and 7 illustrate the manner in which the connector of FIG. 5 is used to connect the attachment to the bottom section of the gate as shown in FIG. 1 and FIG. 2.

DETAILED DESCRIPTION OF THE DRAWINGS

Specifically in FIG. 1, prior art gate 10 consists of U-shaped frame 10 made of legs 10*a* and 10*b* connected at one end by vertical flat plate 11. The U-shaped frame is formed out of an elongated flat plate about two inches wide that is bent into the shape shown in FIG. 1. The open end of frame 10 is attached to pivot pin 12 that extends through holes in the ends of these two members. Pin 12 extends through tubular spacers 14 and 16 that are attached to mounting plate 20 that is attached to guard rail post 27 by U-shaped bolt 21 that is attached to post 22 by nuts (not shown) on the other side of the plate. Coil spring 18 is positioned on pivot pin 12 between the two spacers. One end of the spring engages with mounting plate 18 and the other end engages mounting plate 20 so that the spring will urge the gate to the closed position.

The attachment of this invention is indicated by the number 30. It consists of a frame formed from flat steel plate of the same width as the plate of gate 10. One end is bent upwardly to form vertical leg 34 and then horizontally to form short horizontal leg 40. Short section 40 is attached to side 10*b* of the existing gate by connector 36. Vertical side 35 of the attachment is bent to form short horizontal leg 37 that is attached to pivot pin 12 by nut 39.

Connector 36 consists of a flat steel plate shaped as shown in FIG. 4 that is then bent along the dotted lines shown so that two L-shaped straps 38 and 41 are formed to provide slots 42 and 44 facing in opposite directions between straps 38 and 41 and plate 36. To use the connector to connect short leg 40 to leg 10*b* of the gate, the connector is positioned to extend across the top of leg 10*b* of the gate as shown in FIG. 6. Short leg 40 of the attachment is positioned below leg 10*b*. The connector is rotated in the direction shown by the arrows in FIG. 7 moving straps 38 and 41 under leg 40. Tabs 48 and 50 are then bent upwardly to hold the connector in place and the attachment is firmly connected to lower side 10*b* of original gate 10 to prevent workmen using the catwalk from slipping under the gate and falling into the stairwell.

From the foregoing it will be seen that this invention is one well adapted to attain all of the ends and objects hereinabove set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. In an elevated walkway having a stairwell and a ladder in the stairwell for use in moving through the stairwell to another level, a gate comprising a U-shaped frame having a generally vertical bight and an upper and a lower vertically spaced, parallel, horizontal legs, means for mounting the gate for pivotal movement around a vertical axis through ends of the legs opposite the bight between a first position preventing access to such opening and a second position allowing passage into and out of the opening, stop means for allowing the gate to pivot in only one direction from the first position to the second position, said stop means including means to adjust the first position as required by a location of the opening, and resilient means urging the gate toward the first position to maintain the gate in the first position extending across the opening to prevent passage there through in one direction when the gate is not forceably held in the second position, the improvement comprising an attachment connected to and extending below of the gate to reduce the possibility of a person slipping feet first under the gate into the stairwell said attachment comprising a generally rectangular frame of flat steel bar stock that is bent into a rectangular shape and means connecting the attachment to the lower horizontal leg of the gate to reduce a space between a bottom of the gate and a catwalk.

2. The gate of claim 1 in which the attachment comprises the generally rectangular frame including a top side for attachment to the bottom of the gate, vertical ends extending downwardly from the top side, and a lower horizontal side.

3. The gate of claim 1 further provided with said means connecting the attachment to the lower horizontal leg of the gate, comprising a connector having an elongated body of flat steel plate and L-shaped members attached to the body to form spaced cavities opening in opposite directions to receive the lower horizontal leg of the gate and a top side of the attachment to lock the attachment to the gate.

4. An attachment to a safety gate that extends across a catwalk to close a stairwell in the catwalk to keep personnel using the catwalk from inadvertently falling into the stairwell to increase the safety thereof, said gate including a generally vertical gate post, a generally U-shaped frame having elongated, parallel legs, means attaching the frame to the gate post with the legs in a vertical plane with one leg lower than the other and for pivotal movement around vertical axis between a position closing the ladder way and a position opening the ladder way, said attachment comprising a rectangular frame having a length generally equal to the length of the U-shaped frame, a width sufficient to extend below the U-shaped frame and keep feet of personnel using the catwalk from inadvertently slipping a foot under the attachment, and means connecting the attachment to the lower leg of the gate.

5. The attachment of claim 4 comprising an elongated member for extending horizontally across the catwalk about the same distance as the gate, vertical members attached to opposite ends of the elongated member for connecting to the gate to position the elongated member a desired distance above the catwalk to engage a leg of a passer on the catwalk and limit the distance the foot can move under the gate, vertical members connected at each end of the elongated member for attaching the elongated member to the gate and support the elongated member the desired distance above the catwalk.

* * * * *